US010123587B2

(12) United States Patent
Gishifu et al.

(10) Patent No.: US 10,123,587 B2
(45) **Date of Patent: *Nov. 13, 2018**

(54) ADJUSTABLE BLADDER SYSTEM FOR AN ARTICLE OF FOOTWEAR

(71) Applicant: NIKE, Inc., Beaverton, OR (US)

(72) Inventors: Amy E. Gishifu, Vancouver, WA (US); Elizabeth Langvin, Sherwood, OR (US); James Molyneux, Portland, OR (US); Lee D. Peyton, Tigard, OR (US); Ty A. Ransom, Portland, OR (US); Nicola J. Reynolds, Hillsboro, OR (US); John F. Swigart, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/646,413

(22) Filed: Jul. 11, 2017

(65) Prior Publication Data

US 2017/0303638 A1 Oct. 26, 2017

Related U.S. Application Data

(63) Continuation of application No. 15/215,048, filed on Jul. 20, 2016, now Pat. No. 9,737,113, which is a (Continued)

(51) Int. Cl.

| | |
|---|---|
| ***A43B 13/20*** | (2006.01) |
| ***A43B 21/28*** | (2006.01) |
| ***A43B 5/00*** | (2006.01) |

(52) U.S. Cl.

CPC ..... *A43B 13/203* (2013.01); *A43B 5/00* (2013.01); *A43B 13/20* (2013.01); *A43B 21/28* (2013.01); *A43B 21/285* (2013.01)

(58) Field of Classification Search

CPC ..... A43B 13/203; A43B 13/20; A43B 7/06; A43B 13/18; A43B 13/206

(Continued)

(56) References Cited

U.S. PATENT DOCUMENTS

| | | | |
|---|---|---|---|
| 510,504 | A | 12/1893 | Foster |
| 572,887 | A | 12/1896 | Gallagher |

(Continued)

FOREIGN PATENT DOCUMENTS

| | | | |
|---|---|---|---|
| CN | 2115676 | U | 9/1992 |
| CN | 1153622 | A | 7/1997 |

(Continued)

OTHER PUBLICATIONS

International Preliminary Report on Patentability and Written Opinion for Application No. PCT/US2012/030718, dated Oct. 17, 2013.

(Continued)

*Primary Examiner* — Marie D Bays

(74) *Attorney, Agent, or Firm* — Banner & Witcoff, Ltd.

(57) ABSTRACT

An adjustable bladder system for an article of footwear is disclosed. The bladder system includes an outer bladder that may be inflated using an external pump. In addition, one or more tensile members may be disposed internally to the outer bladder to provide enhanced support. A valve member may also be disposed internally to the outer bladder. The valve member can include a contoured edge to provide a contoured shape for the outer bladder.

20 Claims, 13 Drawing Sheets

Related U.S. Application Data continuation of application No. 14/318,747, filed on Jun. 30, 2014, now Pat. No. 9,420,849, which is a continuation of application No. 13/081,069, filed on Apr. 6, 2011, now Pat. No. 8,813,389.

(58) Field of Classification Search
USPC ..... 36/3 R, 3 B, 28, 29, 35 B
See application file for complete search history.

(56) References Cited

U.S. PATENT DOCUMENTS 586,155 A 7/1897 Bascom
586,166 A 7/1897 Bascom
1,010,187 A 11/1911 Scott
1,011,460 A 12/1911 Maddocks
1,069,001 A 7/1913 Guy
1,304,915 A 5/1919 Spinney
1,498,838 A 6/1924 Harrison, Jr.
1,557,947 A 10/1925 Stewart
2,007,803 A 7/1935 Kelly
2,109,180 A 2/1938 Mohun
3,721,265 A 3/1973 Hoffland
4,129,951 A 12/1978 Petrosky
4,183,156 A 1/1980 Rudy
4,219,945 A 9/1980 Rudy
4,237,625 A 12/1980 Cole et al.
4,358,902 A 11/1982 Cole et al.
4,446,634 A 5/1984 Johnson et al.
4,657,716 A 4/1987 Schmidt
4,670,995 A 6/1987 Huang
4,712,316 A 12/1987 Baggio
4,722,131 A 2/1988 Huang
4,763,426 A 8/1988 Polus et al.
4,856,208 A 8/1989 Zaccaro
4,887,367 A 12/1989 Mackness et al.
4,912,861 A 4/1990 Huang
4,936,029 A 6/1990 Rudy
4,991,317 A 2/1991 Lakic
5,025,575 A 6/1991 Lakic
5,042,176 A 8/1991 Rudy
5,083,361 A 1/1992 Rudy
5,113,599 A 5/1992 Cohen et al.
5,144,708 A 9/1992 Pekar
5,179,792 A 1/1993 Brantingham
5,193,246 A 3/1993 Huang
5,199,191 A 4/1993 Moumdjian
5,224,278 A 7/1993 Jeon
5,228,156 A 7/1993 Wang
5,238,231 A 8/1993 Huang
5,253,435 A 10/1993 Auger et al.
5,295,313 A 3/1994 Lee
5,335,382 A 8/1994 Huang
5,351,710 A 10/1994 Phillips
5,355,552 A 10/1994 Huang
5,384,977 A 1/1995 Chee
5,406,661 A 4/1995 Pekar
5,558,395 A 9/1996 Huang
5,564,143 A 10/1996 Pekar et al.
5,588,227 A 12/1996 Goldston et al.
5,590,696 A 1/1997 Phillips et al.
5,598,645 A 2/1997 Kaiser
5,669,161 A 9/1997 Huang
5,713,141 A 2/1998 Mitchell et al.
5,740,619 A 4/1998 Broder
5,741,568 A 4/1998 Rudy
5,794,361 A 8/1998 Sadler
5,802,738 A 9/1998 Ferniani
5,802,739 A 9/1998 Potter et al.
5,813,142 A 9/1998 Demon
5,830,553 A 11/1998 Huang
5,845,417 A 12/1998 Reed et al.
5,846,063 A 12/1998 Lakic
5,902,660 A 5/1999 Huang
5,907,911 A 6/1999 Huang
5,918,383 A 7/1999 Chee
5,925,306 A 7/1999 Huang
5,937,462 A 8/1999 Huang
5,952,065 A 9/1999 Mitchell et al.
5,979,078 A 11/1999 McLaughlin
5,987,779 A 11/1999 Litchfield et al.
5,996,253 A 12/1999 Spector
6,013,340 A 1/2000 Bonk et al.
6,014,823 A 1/2000 Lakic
6,027,683 A 2/2000 Huang
6,065,150 A 5/2000 Huang
6,082,025 A 7/2000 Bonk et al.
6,119,371 A 9/2000 Goodwin et al.
D431,347 S 10/2000 Bettencourt
6,127,010 A 10/2000 Rudy
6,127,026 A 10/2000 Bonk et al.
6,128,837 A 10/2000 Huang
6,134,812 A 10/2000 Voss
6,161,240 A 12/2000 Huang
6,170,173 B1 1/2001 Caston
6,203,868 B1 3/2001 Bonk et al.
6,282,815 B1 9/2001 Caston
6,298,499 B1 10/2001 Huang
6,305,102 B1 10/2001 Doyle
6,314,663 B1 11/2001 Saldana
6,321,465 B1 11/2001 Bonk et al.
6,391,405 B1 5/2002 Bonk et al.
6,428,865 B1 8/2002 Huang
6,430,843 B1 8/2002 Potter et al.
6,460,197 B2 10/2002 Huang
6,510,624 B1 1/2003 Lakic
6,519,873 B1 2/2003 Buttigieg
6,537,639 B1 3/2003 Huang
6,553,691 B2 4/2003 Huang
6,557,271 B1 5/2003 Weaver, III
6,571,490 B2 6/2003 Tawney et al.
6,585,669 B2 7/2003 Manor et al.
6,725,573 B2 4/2004 Doyle
6,730,379 B2 5/2004 Bonk et al.
6,773,785 B1 8/2004 Huang
6,782,640 B2 8/2004 Westin
6,785,985 B2 9/2004 Marvin et al.
6,865,825 B2 3/2005 Bailey, Sr. et al.
6,889,451 B2 5/2005 Passke et al.
6,915,594 B2 7/2005 Kim
6,971,193 B1 12/2005 Potter et al.
6,976,321 B1 12/2005 Lakic
6,988,329 B2 1/2006 Marvin et al.
7,017,285 B2 3/2006 Lakic
7,047,670 B2 5/2006 Marvin et al.
7,051,456 B2 5/2006 Swigart et al.
7,070,845 B2 7/2006 Thomas et al.
7,107,706 B1 9/2006 Bailey, Sr. et al.
7,131,218 B2 11/2006 Schindler
7,152,625 B2 12/2006 Marvin et al.
7,171,765 B2 2/2007 Lo
7,204,041 B1 4/2007 Bailey, Sr. et al.
7,244,483 B2 7/2007 Tawney et al.
7,254,909 B2 8/2007 Ungari
7,278,445 B2 10/2007 Marvin et al.
7,337,560 B2 3/2008 Marvin et al.
7,340,851 B2 3/2008 Litchfield et al.
7,383,648 B1 6/2008 Litchfield et al.
7,395,614 B1 7/2008 Bailey, Sr. et al.
7,395,615 B2 7/2008 Lee
7,409,780 B2 8/2008 Marvin et al.
7,448,150 B1 11/2008 Davis et al.
7,451,554 B2 11/2008 Hazenberg et al.
7,451,555 B1 11/2008 Lakic
7,478,488 B1 1/2009 Davis et al.
7,784,196 B1 8/2010 Christensen et al.
8,813,389 B2 8/2014 Gishifu et al.
8,844,165 B2 9/2014 Gishifu et al.
9,060,564 B2 6/2015 Langvin et al.
9,420,849 B2 8/2016 Gishifu et al.
9,737,113 B2 * 8/2017 Gishifu ..... A43B 13/203
2001/0045026 A1 11/2001 Huang
2002/0121031 A1 9/2002 Smith et al.
2002/0164257 A1 11/2002 Baek
2002/0194747 A1 12/2002 Passke et al.

(56) References Cited

U.S. PATENT DOCUMENTS

| | | | |
|---|---|---|---|
| 2003/0098118 | A1 | 5/2003 | Rapaport |
| 2004/0010939 | A1 | 1/2004 | Liu et al. |
| 2004/0088882 | A1 | 5/2004 | Buttigieg |
| 2005/0039346 | A1 | 2/2005 | Thomas et al. |
| 2005/0097777 | A1 | 5/2005 | Goodwin |
| 2005/0102858 | A1 | 5/2005 | Yen |
| 2005/0183287 | A1 | 8/2005 | Schindler |
| 2005/0198862 | A1 | 9/2005 | Lo |
| 2005/0241185 | A1 | 11/2005 | Flood et al. |
| 2006/0174518 | A1 | 8/2006 | Fogarty et al. |
| 2006/0196081 | A1 | 9/2006 | Lee |
| 2006/0225304 | A1 | 10/2006 | Goodwin |
| 2008/0066342 | A1 | 3/2008 | Park |
| 2008/0163517 | A1 | 7/2008 | Chen |
| 2008/0222916 | A1 | 9/2008 | Jin |
| 2009/0288312 | A1 | 11/2009 | Dua |
| 2009/0288313 | A1 | 11/2009 | Rapaport et al. |
| 2010/0242303 | A1 | 9/2010 | Callahan et al. |
| 2011/0067264 | A1 | 3/2011 | Doyle |
| 2012/0084998 | A1 | 4/2012 | Biesse |
| 2012/0255196 | A1 | 10/2012 | Gishifu et al. |

FOREIGN PATENT DOCUMENTS

| | | | |
|---|---|---|---|
| CN | 2394475 | Y | 9/2000 |
| CN | 1430476 | A | 7/2003 |
| CN | 1592589 | A | 3/2005 |
| CN | 1856262 | A | 11/2006 |
| CN | 201182250 | Y | 1/2009 |
| CN | 102379481 | A | 3/2012 |
| DE | 2855268 | A1 | 7/1980 |
| FR | 2801174 | A1 | 5/2001 |
| WO | 8703789 | A1 | 7/1987 |
| WO | 9119430 | A1 | 12/1991 |
| WO | 9314659 | A1 | 8/1993 |
| WO | 0119211 | A1 | 3/2001 |
| WO | 200178539 | A2 | 10/2001 |
| WO | 2009027941 | A2 | 3/2009 |

OTHER PUBLICATIONS

International Preliminary Report on Patentability and Written Opinion for Application No. PCT/US2012/030721, dated Oct. 17, 2013.
International Preliminary Report on Patentability and Written Opinion for Application No. PCT/US2012/030724, dated Oct. 17, 2013.
International Preliminary Report on Patentability and Written Opinion for Application No. PCT/US2012/030726, dated Oct. 17, 2013.
International Search Report and Written Opinion for Application No. PCT/US2012/030718, dated Oct. 26, 2012.
International Search Report and Written Opinion for Application No. PCT/US2012/030721, dated Oct. 19, 2012.
International Search Report and Written Opinion for Application No. PCT/US2012/030724, dated Oct. 22, 2012.
International Search Report and Written Opinion for Application No. PCT/US2012/030726, dated Oct. 25, 2012.
Notice of Allowance dated May 28, 2014 in U.S. Appl. No. 13/081,079.
Amendment filed Jun. 4, 2014 in U.S. Appl. No. 13/081,058.
Observations and Voluntary Amendments filed May 16, 2014 in Chinese Patent Application No. 201280015447.5, and English translation thereof.
Response to Office Action filed May 12, 2014 in U.S. Appl. No. 13/081,079.
Office Action dated Feb. 18, 2014 in U.S. Appl. No. 13/081,079.
Response to Office Action filed Mar. 18, 2014 in U.S. Appl. No. 13/081,069.
Office Action dated Mar. 20, 2014 in U.S. Appl. No. 13/081,058.
Response to Written Opinion filed Apr. 28, 2014 in European Patent Application No. 12721619.0.
Response to Written Opinion filed Apr. 28, 2014 in European Patent Application No. 12719521.2.
Response to Written Opinion filed Apr. 8, 2014 in European Patent Application No. 12718765.6.
Observations and Voluntary Amendments filed May 6, 2014 in Chinese Patent Application No. 201280015874.3 and English translation thereof.
Observations and Voluntary Amendments filed Mar. 31, 2014 in Chinese Patent Application No. 201280017035.5 with English translation of the amended claims.
Notice of Allowance dated Jun. 10, 2014 for U.S. Appl. No. 13/081,058.
Response to Office Action for U.S. Appl. No. 13/081,091, filed Aug. 19, 2014.
Notice of Allowance dated Aug. 29, 2014 for U.S. Appl. No. 13/081,091.
Office Action dated May 23, 2014, in U.S. Appl. No. 13/081,091.

* cited by examiner

ADJUSTABLE BLADDER SYSTEM FOR AN ARTICLE OF FOOTWEAR

This application is a continuation of U.S. patent application Ser. No. 15/215,048, filed Jul. 20, 2016, which is a continuation of U.S. patent application Ser. No. 14/318,747, filed Jun. 30, 2014. Application Ser. No. 14/318,747 is a continuation of U.S. patent application Ser. No. 13/081,069, filed Apr. 6, 2011 (now U.S. Pat. No. 8,813,389). Application Ser. No. 14/318,747, Ser. No. 13/081,069, and Ser. No. 15/215,048, in their entireties, are incorporated by reference herein.

BACKGROUND

The present embodiments relate generally to an article of footwear, and in particular to an article of footwear with a bladder system.

SUMMARY

In one aspect, the embodiments provide a bladder system for an article of footwear, comprising: a sole structure including an outer bladder bounding an interior cavity; at least one tensile member disposed inside the interior cavity; a valve member disposed inside the interior cavity, the valve member providing fluid communication between the interior cavity and an exterior of the outer bladder; where the inner bladder is sealed and has a substantially fixed internal pressure; and where the internal pressure of the outer bladder can be adjusted.

In another aspect, the embodiments provide a bladder system for an article of footwear, comprising: a sole structure including an outer bladder, the outer bladder bounding an interior cavity; the outer bladder being substantially deformable; a valve member disposed inside the interior cavity, the valve member including a valve and a fluid passage that provides fluid communication between the valve and the interior cavity; the valve member including a contoured surface that is disposed against a portion of outer bladder; and where the contoured surface of the valve member provides a contoured shape for the portion of outer bladder.

In another aspect, a bladder system for an article of footwear includes a sole structure including an outer bladder bounding an interior cavity, where the outer bladder includes a first portion and a second portion. The bladder system also includes at least one support structure disposed inside the interior cavity and a valve member disposed inside the interior cavity, where the valve member provides fluid communication between the interior cavity and an exterior of the outer bladder. The at least one support structure provides a substantially constant shape for the second portion of the outer bladder and the valve member provides a substantially constant shape for the first portion of the outer bladder.

Other systems, methods, features and advantages of the embodiments will be, or will become, apparent to one of ordinary skill in the art upon examination of the following figures and detailed description. It is intended that all such additional systems, methods, features and advantages be included within this description and this summary, be within the scope of the embodiments, and be protected by the following claims.

BRIEF DESCRIPTION OF THE DRAWINGS

The embodiments can be better understood with reference to the following drawings and description. The components in the figures are not necessarily to scale, emphasis instead being placed upon illustrating the principles of the embodiments. Moreover, in the figures, like reference numerals designate corresponding parts throughout the different views.

DETAILED DESCRIPTION

Figure 1:
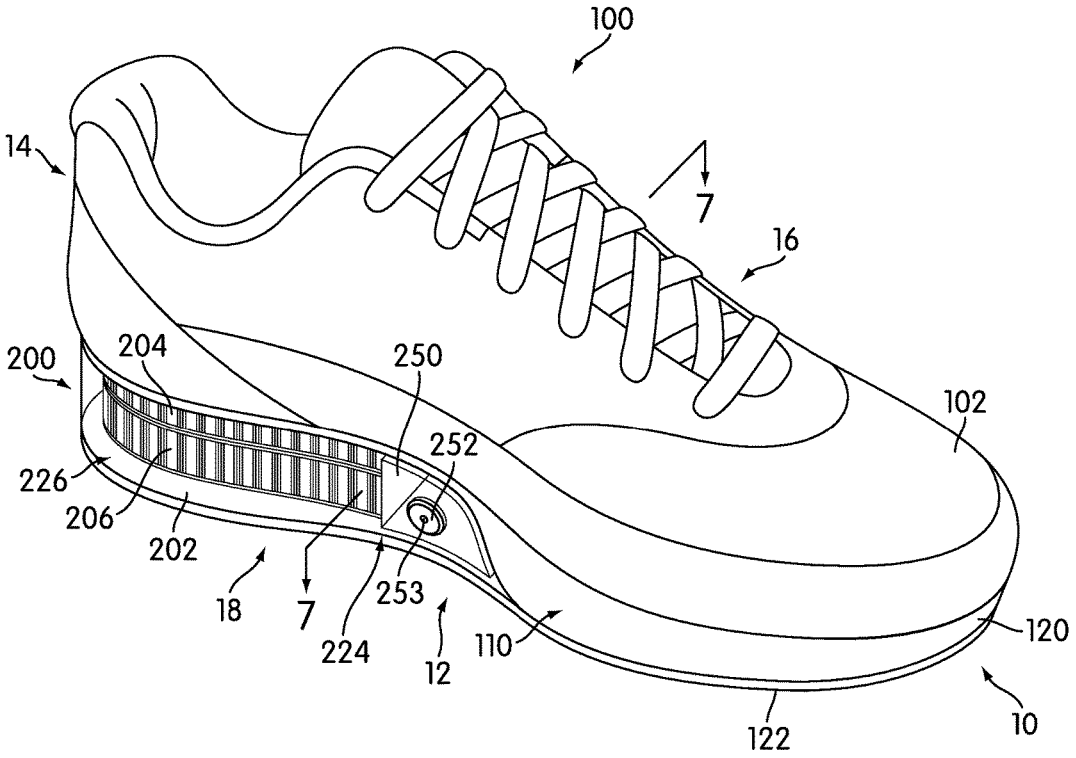
FIG. 1 is an isometric view of an embodiment of an article of footwear with a bladder system.

FIGS. 1 through 4 illustrate views of an exemplary embodiment of article of footwear 100. For clarity, the following detailed description discusses an exemplary embodiment, in the form of a sports shoe, but it should be noted that the present embodiments could take the form of any article of footwear including, but not limited to: hiking boots, soccer shoes, football shoes, sneakers, rugby shoes, basketball shoes, baseball shoes as well as other kinds of shoes. As shown in FIGS. 1 through 4, article of footwear 100, also referred to simply as article 100, is intended to be used with a left foot; however, it should be understood that the following discussion may equally apply to a mirror image of article of footwear 100 that is intended for use with a right foot.

Referring to FIGS. 1 through 4, for purposes of reference, article 100 may be divided into forefoot portion 10, midfoot portion 12 and heel portion 14. Forefoot portion 10 may be generally associated with the toes and joints connecting the metatarsals with the phalanges. Midfoot portion 12 may be generally associated with the arch of a foot. Likewise, heel portion 14 may be generally associated with the heel of a foot, including the calcaneus bone. In addition, article 100 may include lateral side 16 and medial side 18. In particular, lateral side 16 and medial side 18 may be opposing sides of article 100. Furthermore, both lateral side 16 and medial side 18 may extend through forefoot portion 10, midfoot portion 12 and heel portion 14.

It will be understood that forefoot portion 10, midfoot portion 12 and heel portion 14 are only intended for purposes of description and are not intended to demarcate precise regions of article 100. Likewise, lateral side 16 and medial side 18 are intended to represent generally two sides of an article, rather than precisely demarcating article 100 into two halves. In addition, forefoot portion 10, midfoot portion 12 and heel portion 14, as well as lateral side 16 and medial side 18, can also be applied to individual components of an article, such as a sole structure and/or an upper.

For consistency and convenience, directional adjectives are employed throughout this detailed description corresponding to the illustrated embodiments. The term "longitudinal" as used throughout this detailed description and in the claims refers to a direction extending a length of an article. In some cases, the longitudinal direction may extend from a forefoot portion to a heel portion of the article. Also, the term "lateral" as used throughout this detailed description and in the claims refers to a direction extending a width of an article. In other words, the lateral direction may extend between a medial side and a lateral side of an article. Furthermore, the term "vertical" as used throughout this detailed description and in the claims refers to a direction generally perpendicular to a lateral and longitudinal direction. For example, in cases where an article is planted flat on a ground surface, the vertical direction may extend from the ground surface upward. In addition, the term "proximal" refers to a portion of a footwear component that is closer to a portion of a foot when an article of footwear is worn. Likewise, the term "distal" refers to a portion of a footwear component that is further from a portion of a foot when an article of footwear is worn. It will be understood that each of these directional adjectives may be applied to individual components of an article, such as an upper and/or a sole structure.

Article 100 can include upper 102 and sole structure 110. Generally, upper 102 may be any type of upper. In particular, upper 102 may have any design, shape, size and/or color. For example, in embodiments where article 100 is a basketball shoe, upper 102 could be a high top upper that is shaped to provide high support on an ankle. In embodiments where article 100 is a running shoe, upper 102 could be a low top upper.

In some embodiments, sole structure 110 may be configured to provide traction for article 100. In addition to providing traction, sole structure 110 may attenuate ground reaction forces when compressed between the foot and the ground during walking, running or other ambulatory activities. The configuration of sole structure 110 may vary significantly in different embodiments to include a variety of conventional or non-conventional structures. In some cases, the configuration of sole structure 110 can be configured according to one or more types of ground surfaces on which sole structure 110 may be used. Examples of ground surfaces include, but are not limited to: natural turf, synthetic turf, dirt, as well as other surfaces.

Sole structure 110 is secured to upper 102 and extends between the foot and the ground when article 100 is worn. In different embodiments, sole structure 110 may include different components. For example, sole structure 110 may include an outsole, a midsole, and/or an insole. In some cases, one or more of these components may be optional. In an exemplary embodiment, sole structure 110 may include midsole 120 and outsole 122.

In some cases, midsole 120 may be attached directly to upper 102. In other cases, midsole 120 may be attached to a sockliner associated with upper 102. In different embodiments, midsole 120 may have different material characteristics to provide various levels of comfort, cushioning and/or shock absorption. Examples of different materials that could be used for midsole 120 include, but are not limited to: foam, rubber, plastic, polymers, as well as any other kinds of materials.

In some cases, outsole 122 may be configured to provide traction for sole structure 110 and article 100. Outsole 122 can include one or more tread elements and/or ground penetrating members such as cleats. Outsole 122 can have different material characteristics to provide varying levels of traction with a ground. Examples of different materials that could be used for outsole 122 include, but are not limited to: plastic, rubber, polymers as well as any other kinds of materials that are both durable and wear resistant.

A sole structure can include provisions for enhancing cushioning and shock absorption for an article of footwear. Article 100 may include bladder system 200. Generally, bladder system 200 may be disposed in any portion of article 100. In some cases, bladder system 200 may be disposed in forefoot portion 10 of sole structure 110. In other cases, bladder system 200 may be disposed in midfoot portion 12 of sole structure 110. In still other cases, bladder system 200 may be disposed in heel portion 14 of sole structure 110. In an exemplary embodiment, bladder system 200 may be disposed in heel portion 14 of sole structure 110.

Bladder system 200 may include outer bladder 202. Outer bladder 202 may comprise one or more layers that are generally impermeable to fluid. In the current embodiment, outer bladder 202 comprises upper layer 220 and lower layer 222 that are joined together at first periphery 221 and second periphery 223. Moreover, upper layer 220 and lower layer 222 comprise a boundary surface that encloses interior cavity 230.

Outer bladder 202 includes first portion 224 and second portion 226. First portion 224 generally extends into midfoot portion 12 of sole structure 110. Second portion 226 generally extends through heel portion 14 of sole structure 110. In addition, in the current embodiment, the height of outer bladder 202 is substantially constant in second portion 226 and tapers in first portion 224.

Bladder system 200 can include valve member 250 that facilitates the inflation of outer bladder 202. Valve member 250 is disposed within interior cavity 230 of outer bladder 202. Valve member 250 comprises a plug-like portion that receives valve 252 and supports the transfer of fluid into outer bladder 202. In some embodiments, valve member 250 may be substantially more rigid than outer bladder 202. This arrangement helps protect valve 252 as well as any tubing or fluid lines connected to valve 252. In other embodiments, however, the rigidity of valve member 250 could be substantially less than or equal to the rigidity of outer bladder 202

Figure 3:
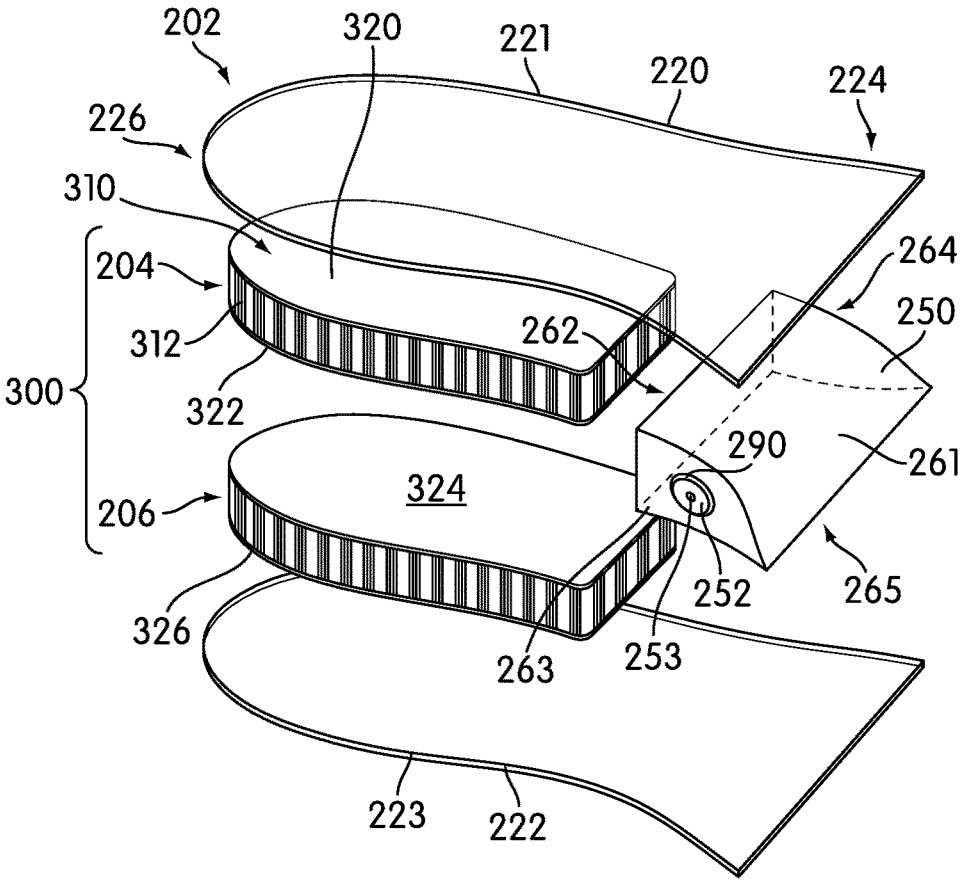
FIG. 3 is an isometric exploded view of an embodiment of a bladder system.
Figure 4:
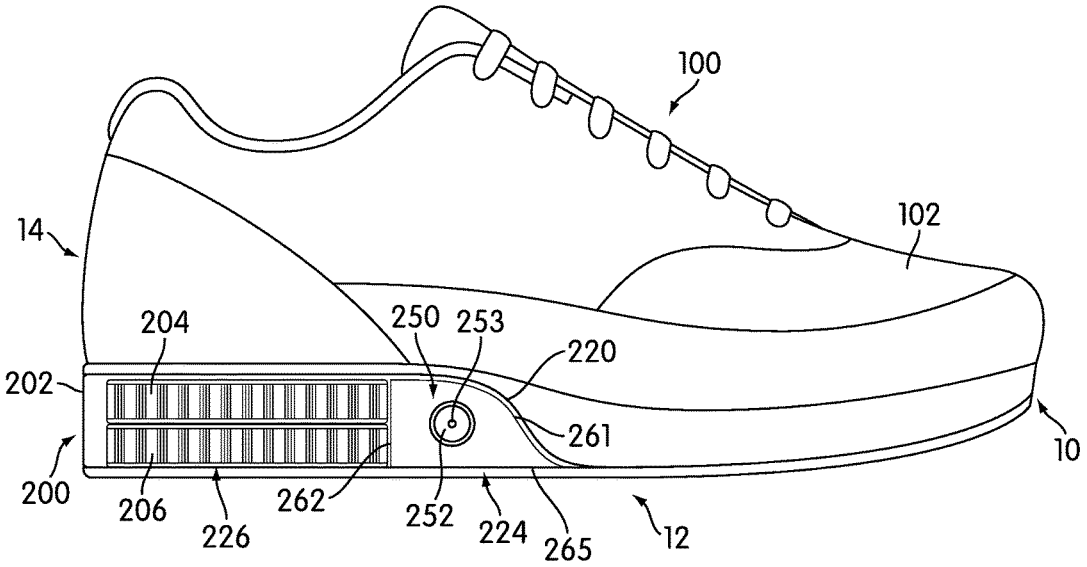
FIG. 4 is a side view of an embodiment of an article of footwear with a bladder system.
Figure 5:
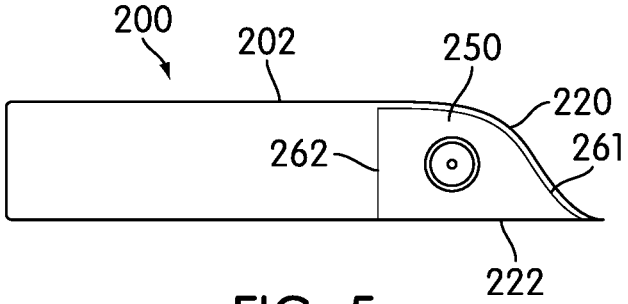
FIG. 5 is a side view of an embodiment of a bladder system.

For purposes of describing valve member 250, valve member 250 may be characterized by a plurality of surfaces (see FIG. 3). In the current embodiment, valve member 250 includes first surface 261, second surface 262, third surface 263, fourth surface 264 and fifth surface 265. First surface 261 is a forwardly oriented surface and second surface 262 is a rearwardly oriented surface. Additionally, third surface 263 is a medial surface and fourth surface 264 is a lateral surface. Furthermore, fifth surface 265 is a lower surface.

Valve 252 may be partially inserted into orifice 290 of third surface 263. In addition, valve 252 may include fluid port 253 that is exposed on an outer surface of outer bladder 202. In some cases, valve 252 may protrude through a portion of outer bladder 202 so that valve 252 can engage with an external pump. In an exemplary embodiment, outer bladder 202 is sealed around a portion of valve 252 that extends through outer bladder 202.

Generally, valve 252 may be any type of valve that is configured to engage with an external pump of some kind. In one embodiment, valve 252 could be a Schrader valve. In another embodiment, valve 252 could be a Presta valve. In still other embodiments, valve 252 could be any other type of valve known in the art.

Figure 6:
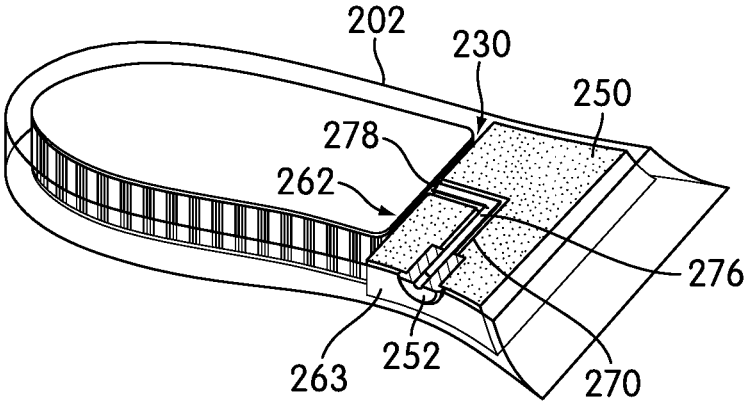
FIG. 6 is a cutaway view of an embodiment of a bladder system.
Figure 7:
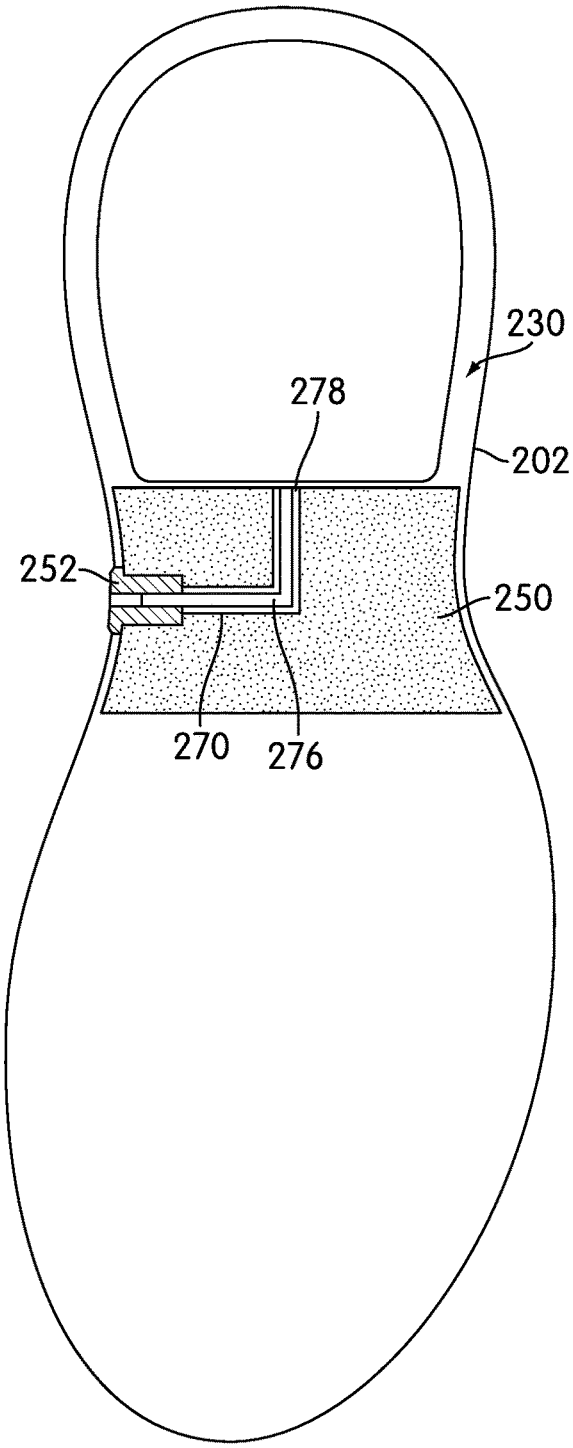
FIG. 7 is a cross-sectional view of an embodiment of a bladder system.

Referring to FIGS. 6 and 7, valve member 250 may be configured to deliver fluid between an external pump and interior cavity 230 of outer bladder 202. In some cases, an interior portion of valve member 250 can include fluid passage 270. Fluid passage 270 may be a hollowed out portion of valve member 250 that extends between third surface 263 and second surface 262. In some cases, a tube or fluid line may be disposed within fluid passage 270. In other cases, fluid may travel through fluid passage 270 directly, without the use of a separate tube or fluid line. In the current embodiment, fluid line 276 extends between valve 252 and fluid outlet 278 of fluid line 276. This arrangement provides fluid communication between interior chamber 230 and an external pump that may be engaged with valve 252 so that outer bladder 202 can be inflated.

Referring back to FIGS. 1 through 4, in some embodiments, bladder system 200 may include one or more supporting structures disposed within outer bladder 202. In the different embodiments, different types of supporting structures could be used including, but not limited to: tensile members and inner bladders. In one embodiment, bladder system may include one or more tensile members disposed within outer bladder 202. In the current embodiment, bladder system 200 includes first tensile member 204 and second tensile member 206. Although two tensile members are used in the current embodiment, other embodiments could include a single tensile member. Still other embodiments could include more than two tensile members.

Figure 2:
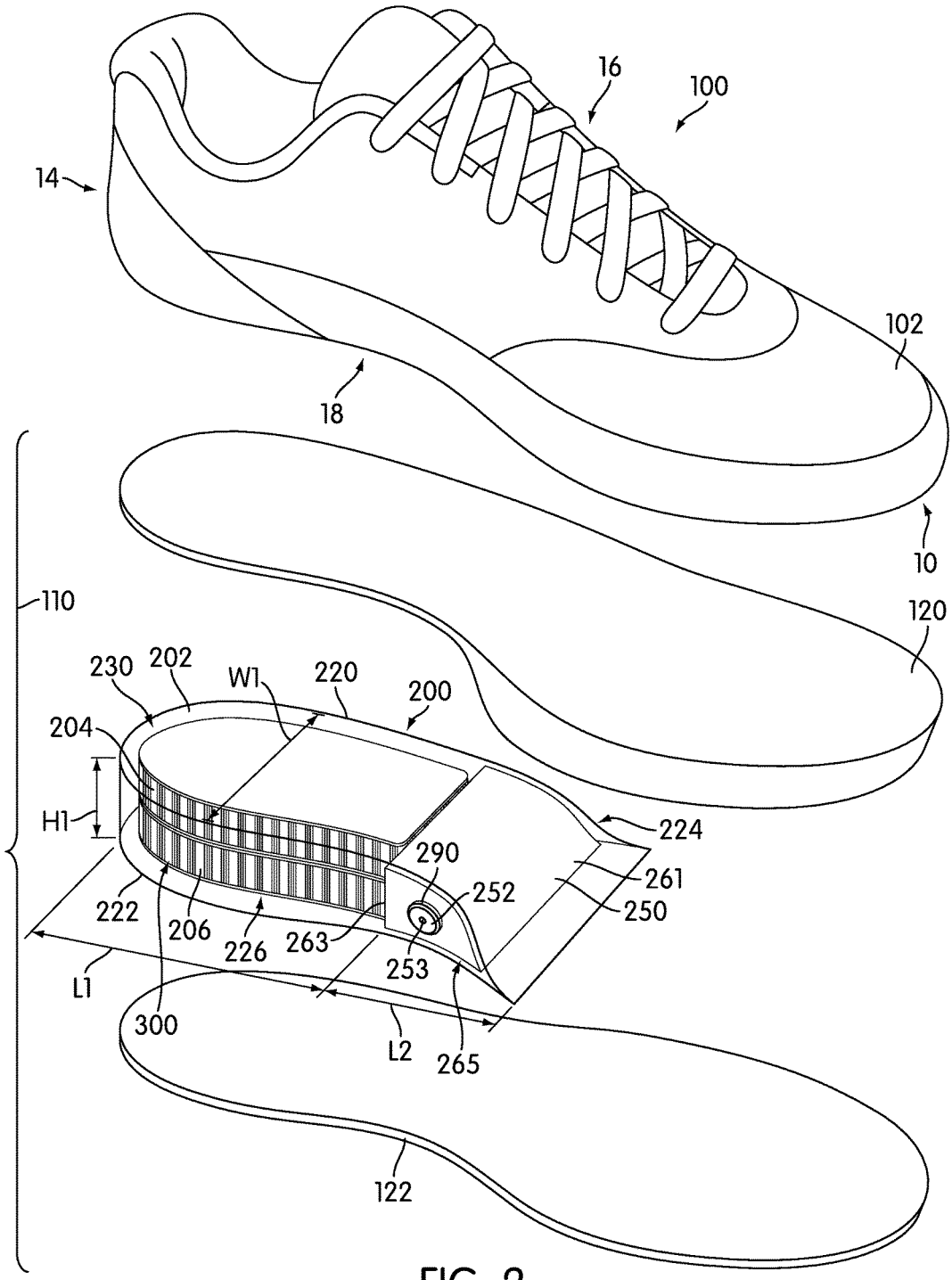
FIG. 2 an isometric exploded view of an embodiment of an article of footwear with a bladder system.

Referring now to FIGS. 2 and 3, in order to provide stability and support, first tensile member 204 and second tensile member 206 may be arranged as a stacked tensile member 300. In some cases, stacked tensile member 300 may be disposed in interior cavity 230 of outer bladder 202. In some cases, first tensile member 204 and second tensile member 206 may be stacked in an approximately vertical direction (that is a direction perpendicular to both the longitudinal and lateral directions of article 100).

Referring to FIG. 3, first tensile member 204 and second tensile member 206 may be spaced textiles (or spacer-knit textiles). In particular, first tensile member 204 and second tensile member 206 may include textile layers 310 as well as connecting members 312 that extend between the textile layers 310. For example, first tensile member 204 includes first textile layer 320 and second textile layer 322, while second tensile member 206 includes third textile layer 324 and fourth textile layer 326. In some cases, first textile layer 320 may be attached to upper layer 220 of outer bladder 202. Additionally, in some cases, fourth textile layer 326 may be attached to lower layer 222 of outer bladder 202. Furthermore, in some cases, second textile layer 322 and third textile layer 324 may be attached to one another to join first tensile member 204 and second tensile member 206.

In some embodiments, first tensile member 204 could be substantially similar to second tensile member 206. In other embodiments, however, first tensile member 204 could differ from second tensile member 206 in size, shape, material characteristics as well as any other features. In the current embodiment, first tensile member 204 may share substantially similar material and structural properties to second tensile member 206. In addition, first tensile member 204 may have a substantially geometry to second tensile member 206.

Using this arrangement, first tensile member 204 and second tensile member 206 may provide structural reinforcement for outer bladder 202. In particular, as a compression force is applied to outer bladder 202 (such as during heel contact with a ground surface) the outward force of fluid puts connecting members 312 in tension. This acts to prevent further outward movement of textile layers 310 and thereby prevents further outward movement of outer bladder 202. This arrangement helps to control the deformation of outer bladder 202, which might otherwise be fully compressed during heel strikes with a ground surface.

Examples of different configurations for a bladder including tensile members are disclosed in Swigart, U.S. Patent Publication Number US2012/0102782, published May 3, 2012 (U.S. application Ser. No. 12/938,175, filed Nov. 2, 2010), the entirety of which is hereby incorporated by reference. Further examples are disclosed in Dua, U.S. Pat. No. 8,151,486, issued Apr. 10, 2012 (U.S. application Ser. No. 12/123,612, filed May 20, 2008), and Rapaport et al., U.S. Pat. No. 8,241,451, issued Aug. 14, 2012 (U.S. application Ser. No. 12/123,646, filed May 20, 2008), the entirety of both being hereby incorporated by reference in their entirety. An example of configurations for tensile members manufactured using a flat-knitting process is disclosed in Dua, U.S. Pat. No. 8,151,486, issued Apr. 10, 2012 (U.S. application Ser. No. 12/123,612, filed May 20, 2008), the entirety of which is hereby incorporated by reference.

A bladder system can include provisions to assist in structurally supporting an outer bladder. In some cases, one or more tensile members may be arranged within an outer bladder to provide structural support to the outer bladder. In other cases, a valve member may be arranged within an outer bladder to provide structural support to the outer bladder. In an exemplary embodiment, tensile members and a valve member may be arranged within an outer bladder to provide structural support to the outer bladder.

Referring to FIG. 2, in some embodiments, first tensile member 204, second tensile member 206 and valve member 250 may be disposed internally to outer bladder 202 in a manner that provides structural support to outer bladder 202. In particular, the sizes and shapes of first tensile member 204 and second tensile member 206 may be selected to substantially fill the interior of second portion 226. For example, in the current embodiment, stacked tensile member 300 has a substantially similar shape to outer bladder 202. Moreover, the size of stacked tensile member 300 is selected to be substantially similar to the size of outer bladder 202. For example, in the current embodiment, first tensile member 204 and second tensile member 206 have widths that are approximately similar to width W1 of second portion 226. Likewise, first tensile member 204 and second tensile member 206 have lengths that are approximately similar to length L1 of second portion 226. Moreover, when first tensile member 204 and second tensile member 206 are stacked in the vertical direction the combined heights of first tensile member 204 and second tensile member 206 is approximately similar to height H1 of second portion 226.

Although first tensile member 204 and second tensile member 206 have substantially similar dimensions to second portion 226 in the current embodiment, in other embodiments the dimensions of first tensile member 204 and second tensile member 206 could vary. For example, in some cases, the widths of one or more tensile members could be in the range between 50 to 100 percent of the value of width W1. In other cases, the widths of one or more tensile members could be in the range between 80 to 100 percent of the value of width W1. Likewise, in other embodiments, the lengths of one or more tensile members could be in the range between 50 to 100 percent of the value of length L1. In other cases, the lengths of one or more tensile members could be in the range between 80 to 100 percent of the value of length L1. Likewise, in other embodiments, the combined heights of two or more tensile members could vary in the range between 50 to 100 percent of the value of height H1. In other cases, the combined heights could be in the range between 80 to 100 percent of the value of height H1.

Using the arrangement discussed here, first tensile member 204 and second tensile member 206 may provide structural support for second portion 226 of outer bladder 202. In particular, first tensile member 204 and second tensile member 206 may help maintain a substantially constant shape for second portion 226 regardless of the inflation pressure of outer bladder 202. This allows a user to adjust the pressure of outer bladder 202 without substantially varying the shape of outer bladder 202. As an example, this arrangement allows a user to adjust the pressure of outer bladder 202 without changing the height of heel portion 14 of article 100.

It will be understood that while two tensile members are used in the current embodiment, other embodiments can include any number of tensile members or other supporting structures. In another embodiment, a single tensile member could be used. In still another embodiment, three or more tensile members could be used. In addition, multiple tensile members could be stacked or combined in any manner to provide structural support for one or more portions of an outer bladder.

Valve member 250 may be disposed within outer bladder 202 in a manner that provides structural support to outer bladder 202. In particular, the size and shape of valve member 250 may be selected to substantially fill the interior of first portion 224 of outer bladder 202. For example, in the current embodiment, the width of valve member 250 may be approximately equal to width W1 of first portion 224. In addition, in the current embodiment, the length of valve member 250 may be approximately equal to length L2 of first portion 224.

Although the width and length of valve member 250 may be substantially similar to the width and length of first portion 224 in the current embodiment, in other embodiments the dimensions could vary. For example, in other cases, the width of valve member 250 may be in the range between 50 to 100 percent of the value of width W1. In still other cases, the width of valve member 250 may be in the range between 80 to 100 percent of the value of width W1. Likewise, in other cases, the length of valve member 250 may be in the range between 50 to 100 percent of the value of length L2. In still other cases, the length of valve member 250 may be in the range between 80 to 100 percent of the value of length L2.

A bladder system can include provisions for maintaining a contoured edge for an outer bladder. In some embodiments, the geometry of a valve member can be contoured to provide a contoured edge for an outer bladder. In an exemplary embodiment, a valve member may have a contoured forward surface that provides a contoured edge for a forward portion of an outer member.

Generally, valve member 250 may be provided with any geometry. In some cases, the geometry of valve member 250 may be approximately box-like with a rectangular cross section. In other cases, valve member 250 may have any other three dimensional geometry including, but not limited to: a cuboid, a sphere, a pyramid, a prism, a cylinder, a cone, a cube, a regular three dimensional shape, an irregular three dimensional shape as well as any other kind of shape.

Referring to FIGS. 2 through 5, as previously discussed, valve member 250 comprises first surface 261 and second surface 262. Second surface 262 is an inward facing surface that faces towards an interior of outer bladder 202. In particular, in some cases, second surface 262 may be oriented towards first tensile member 204 and second tensile member 206. In contrast, first surface 261 is an outward facing surface that faces towards an exterior of outer bladder 202. In this case, first surface 261 is disposed adjacent to upper layer 220 of outer bladder 202.

In the current embodiment, second surface 262 is a generally flat surface that extends between lower layer 222 and upper layer 220 of outer bladder 202. In contrast, first surface 261 is a contoured surface with a height that tapers from second surface 262 to fifth surface 265. In some cases, first surface 261 may have a convex shape. Moreover, the contoured shape of first surface 261 provides a contoured shape for first portion 224 of outer bladder 202. In particular, the height of first portion 224 decreases in a non-linear manner from a maximum height H1 to approximately zero.

Using the arrangement discussed here, valve member 250 may provide structural support for first portion 224 of outer bladder 202. In particular, valve member 250 may help maintain a substantially constant shape for first portion 224 regardless of the inflation pressure of outer bladder 202. This allows a user to adjust the pressure of outer bladder 202 without substantially varying the shape of outer bladder 202 and thus the vertical position of a heel within article 100. Furthermore, the geometry of valve member 250 provides a substantially contoured shape for first portion 224 that helps enhance the transition between the different portions of midsole 122 and helps enhance comfort.

Figure 8:
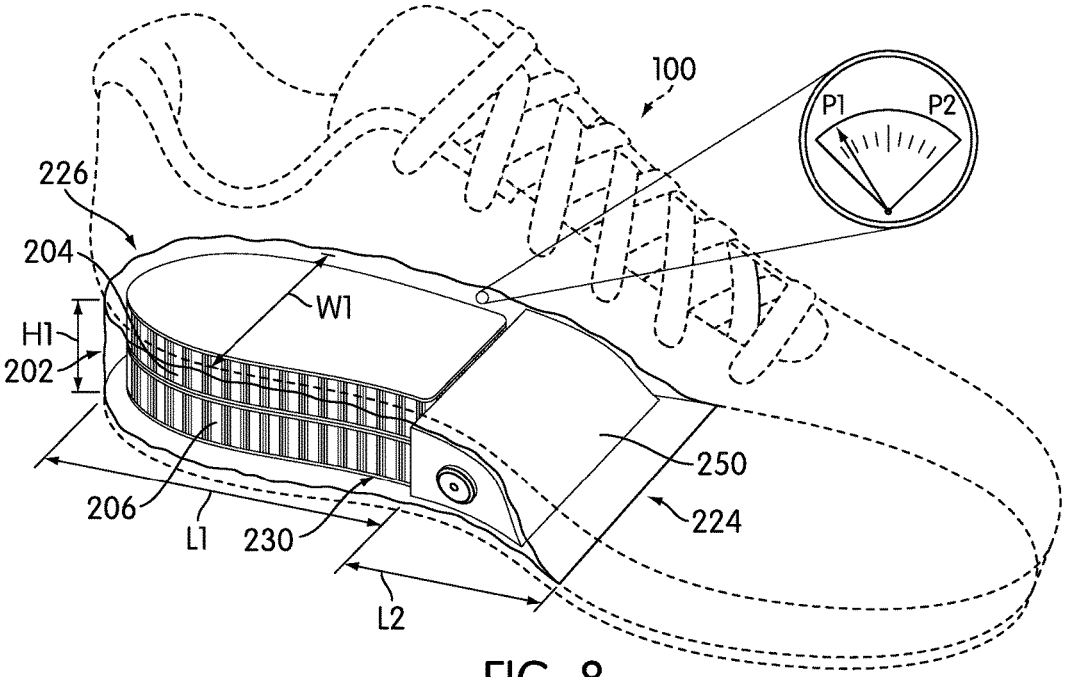
FIG. 8 is an isometric view of an embodiment of an article of footwear with a bladder system in a partially inflated state.
Figure 9:
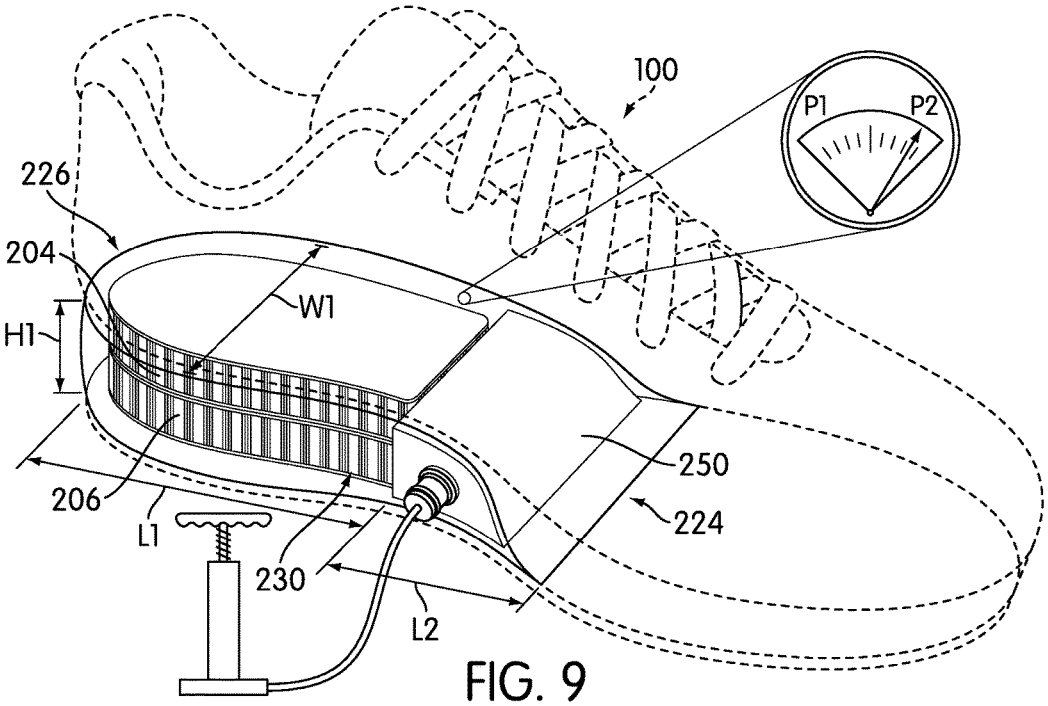
FIG. 9 is an isometric view of an embodiment of article of footwear with a bladder system in a fully inflated state.

FIGS. 8 and 9 illustrate embodiments of bladder system 200 in a partially inflated state and a fully inflated state. Referring to FIG. 8, outer bladder 202 is in a partially inflated state. In this case, interior cavity 230 has internal pressure P1, indicated schematically in this Figure. Although outer bladder 202 is only partially inflated, the presence of first tensile member 204 and second tensile member 206 prevents second portion 226 of outer bladder 202 from deforming under forces applied by a foot within article 100. Likewise, the presence of valve member 250 prevents first portion 224 from deforming under forces applied by a foot within article 100. Referring now to FIG. 9, outer bladder 202 is in a fully inflated state. In this case, interior cavity 230 has an internal pressure P2 that is substantially greater than internal pressure P1. Although the pressure of outer bladder 202 has substantially increased, the overall shape of outer bladder 202 is approximately unchanged between the partially inflated and fully inflated states. Specifically, outer bladder 202 has an approximate length L1, width W1 and height H1 that are substantially unchanged between the partially inflated and fully inflated states. Furthermore, valve member 250 provides a substantially contoured shape for first portion 224 of outer bladder 202 in both the partially inflated state and the fully inflated state. This arrangement helps maintain a gradual transition between the cushioned heel portion 14 and the non-cushioning forefoot portion 10 of article 100.

It should be understood that the approximate shapes and dimensions for outer bladder 202 discussed above may be maintained even when compressive forces are applied to outer bladder 202 by a foot and a ground surface. In particular, the shape and volumes of first tensile member 204, second tensile member 206 and valve member 250 may remain substantially constant regardless of the internal pressure of outer bladder 202. Therefore, compressive forces applied to outer bladder 202 may not substantially change the sizes and shapes of first tensile member 204, second tensile member 206 and valve member 250.

An outer bladder can be filled with any type of fluid. In some cases, a bladder can be configured to receive a gas including, but not limited to: air, hydrogen, helium, nitrogen or any other type of gas including a combination of any gases. In other cases, the bladder can be configured to receive a liquid, such as water or any other type of liquid including a combination of liquids. In an exemplary embodiment, a fluid used to fill a bladder can be selected according to desired properties such as compressibility. For example, in cases where it is desirable for a bladder to be substantially incompressible, a liquid such as water could be used to fill the inflatable portion. Also, in cases where it is desirable for a bladder to be partially compressible, a gas such as air could be used to fill the inflatable portion. In an exemplary embodiment, outer bladder 202 may be filled with air that is pumped into outer bladder 202 using an external pump of some kind.

Materials that may be useful for forming the outer walls of an outer bladder can vary. In some cases, outer bladder 202 may comprise of a rigid to semi-rigid material. In other cases, outer bladder 202 may comprise of a substantially flexible material. Outer bladder 202 may be made of various materials in different embodiments. In some embodiments, outer bladder 202 can be made of a substantially flexible and resilient material that is configured to deform under fluid forces. In some cases, outer bladder 202 can be made of a plastic material. Examples of plastic materials that may be used include high density polyvinyl-chloride (PVC), polyethylene, thermoplastic materials, elastomeric materials as well as any other types of plastic materials including combinations of various materials. In embodiments where thermoplastic polymers are used for a bladder, a variety of thermoplastic polymer materials may be utilized for the bladder, including polyurethane, polyester, polyester polyurethane, and polyether polyurethane. Another suitable material for a bladder is a film formed from alternating layers of thermoplastic polyurethane and ethylene-vinyl alcohol copolymer, as disclosed in U.S. Pat. Nos. 5,713,141 and 5,952,065 to Mitchell et al, hereby incorporated by reference. A bladder may also be formed from a flexible microlayer membrane that includes alternating layers of a gas barrier material and an elastomeric material, as disclosed in U.S. Pat. Nos. 6,082,025 and 6,127,026 to Bonk et al., both hereby incorporated by reference. In addition, numerous thermoplastic urethanes may be utilized, such as PELLETHANE, a product of the Dow Chemical Company; ELASTOLLAN, a product of the BASF Corporation; and ESTANE, a product of the B.F. Goodrich Company, all of which are either ester or ether based. Still other thermoplastic urethanes based on polyesters, polyethers, polycaprolactone, and polycarbonate macrogels may be employed, and various nitrogen blocking materials may also be utilized. Additional suitable materials are disclosed in U.S. Pat. Nos. 4,183,156 and 4,219,945 to Rudy, hereby incorporated by reference. Further suitable materials include thermoplastic films containing a crystalline material, as disclosed in U.S. Pat. Nos. 4,936,029 and 5,042,176 to Rudy, hereby incorporated by reference, and polyurethane including a polyester polyol, as disclosed in U.S. Pat. Nos. 6,013,340; 6,203,868; and U.S. Pat. No. 6,321,465 to Bonk et al., also hereby incorporated by reference. In an exemplary embodiment, outer bladder 202 may comprise one or more layers of thermoplastic-urethane (TPU).

Figure 10:
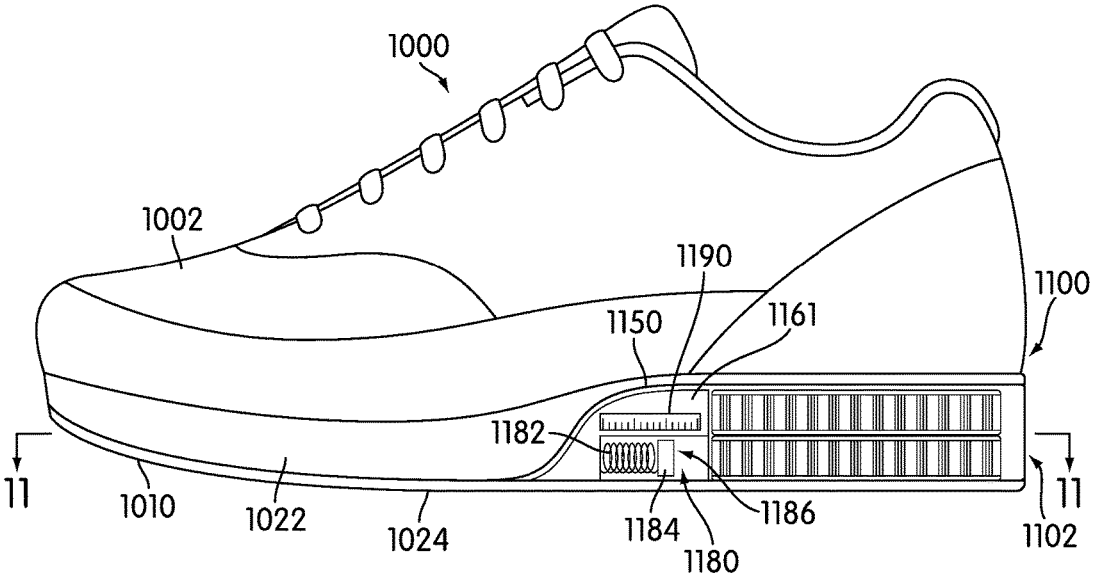
FIG. 10 is an alternative embodiment of an article of footwear with a bladder system.
Figure 11:
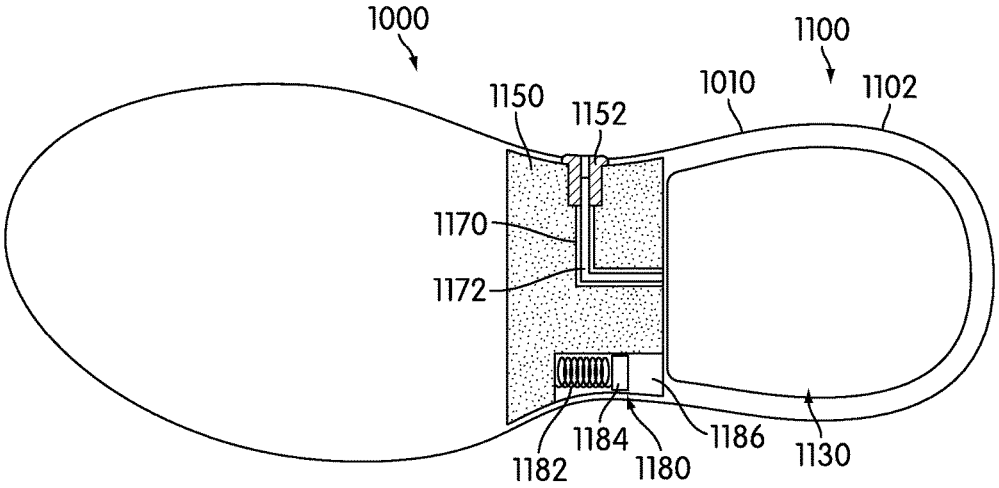
FIG. 11 is a cross-sectional view of an embodiment of an article of footwear with a bladder system.
Figure 12:
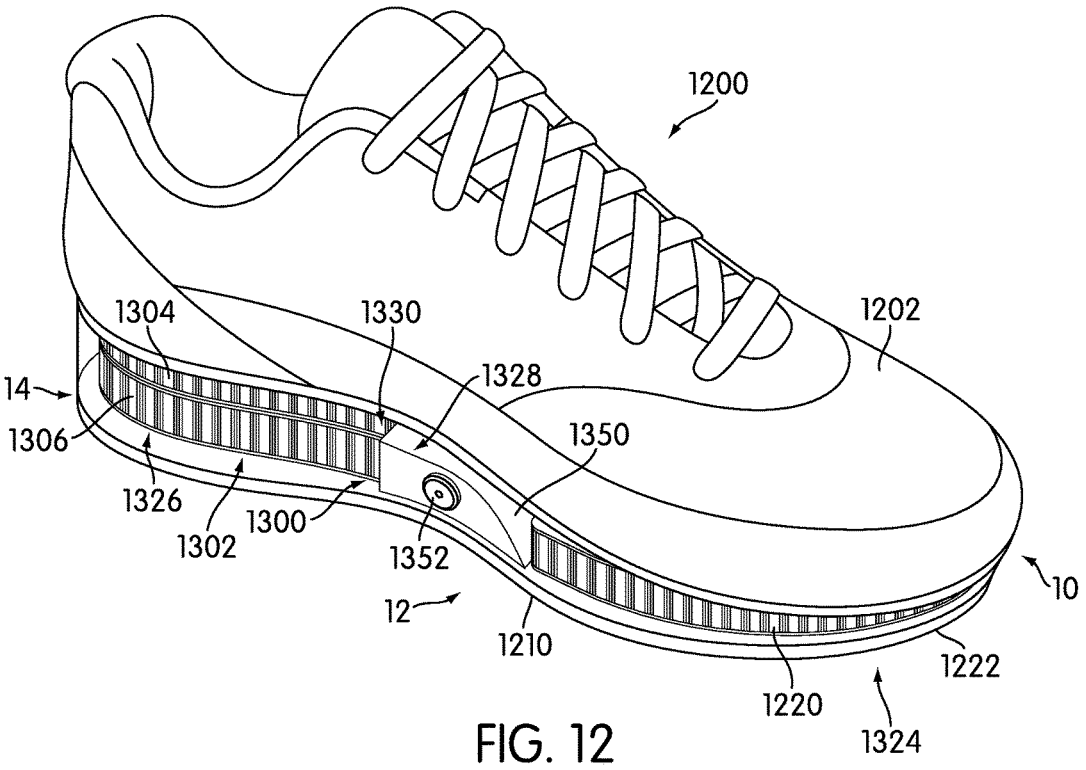
FIG. 12 is an isometric view of an embodiment of an article of footwear with a full length bladder system.
Figure 13:
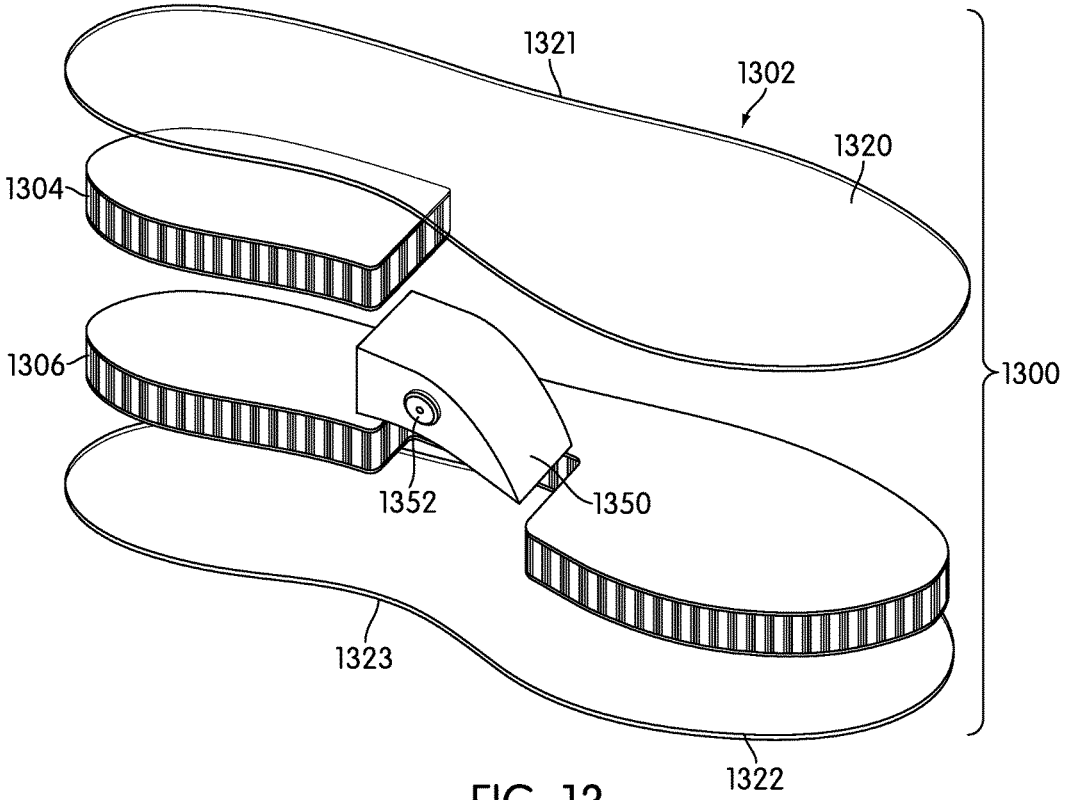
FIG. 13 is an exploded isometric view of an embodiment of a full length bladder system.
Figure 14:
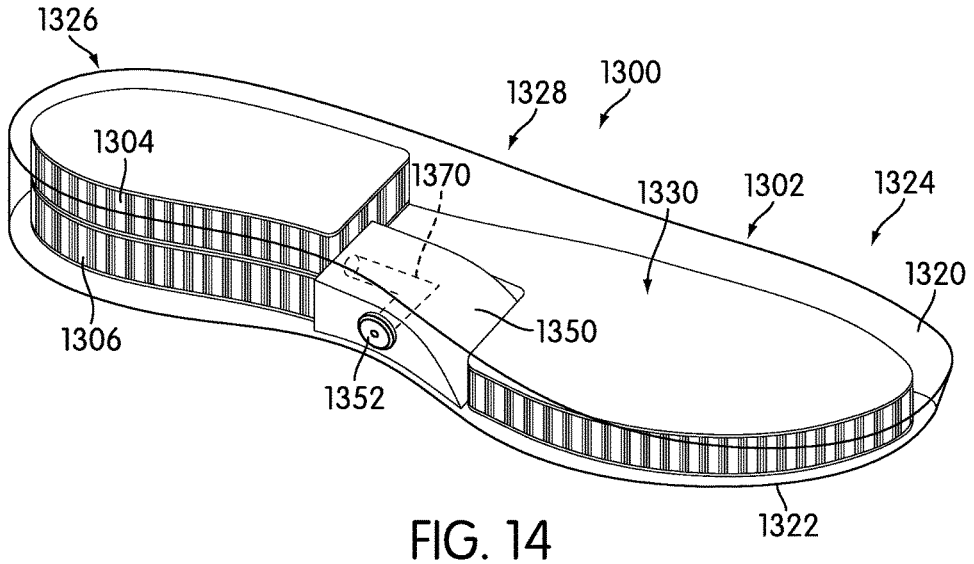
FIG. 14 is an isometric view of an embodiment of a full length bladder system.
Figure 15:
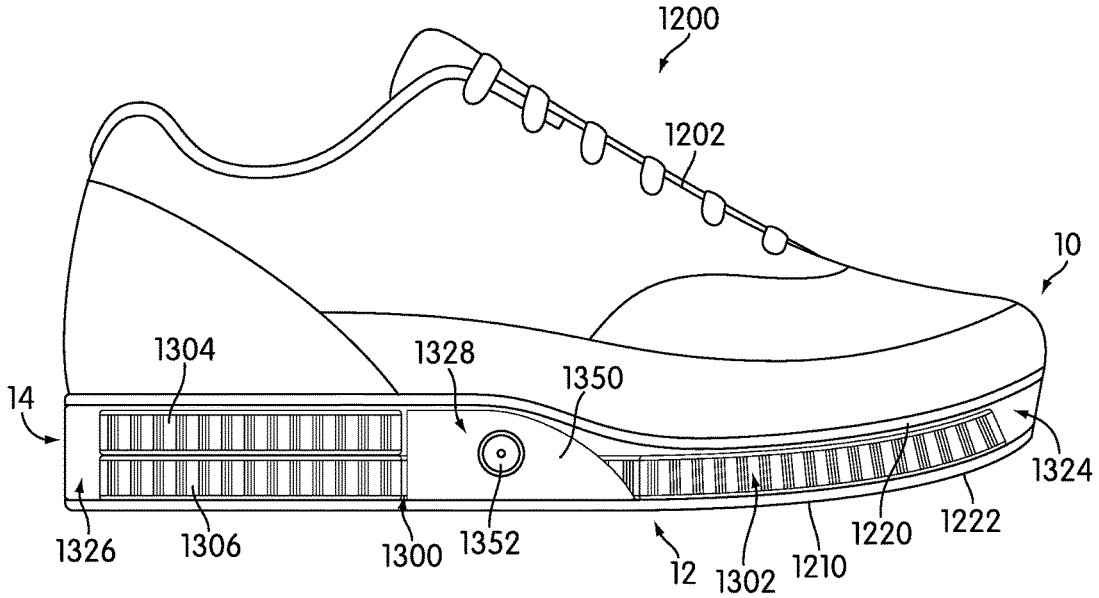
FIG. 15 is a side view of an embodiment of an article of footwear with a full length bladder system.

FIGS. 10 and 11 illustrate an alternative embodiment of an article with a bladder system. Referring to FIGS. 10 and 11, article of footwear 1000 includes upper 1002 and sole structure 1010. Sole structure 1010 further comprises midsole 1022 and outsole 1024.

Sole structure 1010 may also include bladder system 1100. Bladder system 1100 includes outer bladder 1102 and valve member 1150. Valve member 1150 further includes valve 1152. In this embodiment, the arrangement of valve member 1150 and valve 1152 may be substantially similar to the embodiments discussed above. In this case, valve member 1150 includes fluid passage 1170. Moreover, fluid line 1172 extends through fluid passage 1170 and provides fluid communication between valve 1152 and interior cavity 1130. This arrangement allows a user to inflate outer bladder 1102 by attaching an external pump to valve 1152.

Generally, valve member 1150 could have any geometry. Examples include any of the geometries already discussed for valve member 250 of the previous embodiment. In an exemplary embodiment, valve member 1150 may have a substantially similar contoured geometry to the embodiment previously discussed and shown in the earlier Figures. This arrangement may provide a smooth transition between portions of midsole 1022 that include outer bladder 1102 and portions of midsole 1022 that do not include outer bladder 1102.

A bladder system can include provisions for providing information about the pressure level inside of an interior chamber. In some cases, a bladder system can include a pressure gauge of some kind. In an exemplary embodiment, a bladder system can include a pressure gauge that extends through a portion of a valve member.

In the current embodiment, valve member 1150 includes pressure gauge assembly 1180. Pressure gauge assembly 1180 comprises spring 1182 and moveable portion 1184. In addition, valve member 1150 includes recessed portion 1186 that is configured to receive spring 1182 and moveable portion 1184.

As seen in the Figures, moveable portion 1184 may be disposed between an interior wall of recessed portion 1186 and a portion of outer bladder 1102. Spring 1182 is attached to recessed portion 1186 and supports moveable portion 1184. As the pressure inside interior cavity 1130 varies, the force of fluid against moveable portion 1184 may cause spring to expand and/or contract. For example, as the pressure inside interior cavity 1130 increases, the force of fluid against moveable portion 1184 may cause spring 1182 to contract. As the pressure inside interior cavity 1130 decreases, a restoring force may cause spring 1182 to expand and thereby move moveable portion 1184. Therefore, the relative position of moveable portion 1184 may be used as an indicator of the pressure inside interior cavity 1130.

In the current embodiment, surface 1161 of valve member 1150 may include markings that indicate various pressure levels. In this case, surface 1161 includes pressure markings 1190. In some cases, pressure markings 1190 may be calibrated to indicate a particular pressure according to the position of moveable portion 1184. This may allow a user to read off the internal pressure of outer bladder 1102 by noting the position of moveable portion 1184 relative to pressure markings 1190. In particular, in embodiments where outer bladder 1102 is made of a partially transparent material, the position of moveable portion 1184 and pressure markings 1190 may be visible through outer bladder 1102.

FIGS. 12 through 15 illustrate another embodiment of an article of footwear including a bladder system. Referring to FIGS. 12 through 15, article of footwear 1200, hereby simply referred to as article 1200, can include upper 1202 and sole structure 1210. Generally, upper 1202 may be any type of upper. In particular, upper 1202 may have any design, shape, size and/or color. For example, in embodiments where article 1200 is a basketball shoe, upper 1202 could be a high top upper that is shaped to provide high support on an ankle. In embodiments where article 1200 is a running shoe, upper 1202 could be a low top upper.

In some embodiments, sole structure 1210 may be configured to provide traction for article 1200. In addition to providing traction, sole structure 1210 may attenuate ground reaction forces when compressed between the foot and the ground during walking, running or other ambulatory activities. The configuration of sole structure 1210 may vary significantly in different embodiments to include a variety of conventional or non-conventional structures. In some cases, the configuration of sole structure 1210 can be configured according to one or more types of ground surfaces on which sole structure 1210 may be used. Examples of ground surfaces include, but are not limited to: natural turf, synthetic turf, dirt, as well as other surfaces.

Sole structure 1210 is secured to upper 1202 and extends between the foot and the ground when article 1200 is worn. In different embodiments, sole structure 1210 may include different components. For example, sole structure 1210 may include an outsole, a midsole, and/or an insole. In some cases, one or more of these components may be optional. In an exemplary embodiment, sole structure 1210 may include midsole 1220 and outsole 1222.

In some cases, midsole 1220 may be attached directly to upper 1202. In other cases, midsole 1220 may be attached to a sockliner associated with upper 1202. In a different embodiment, midsole 1220 may have different material characteristics to provide various levels of comfort, cushioning and/or shock absorption. Examples of different materials that could be used for midsole 1220 include, but are not limited to: foam, rubber, plastic, polymers, as well as any other kinds of materials.

In some cases, outsole 1222 may be configured to provide traction for sole structure 1210 and article 1200. Outsole 1222 can include one or more tread elements and/or ground penetrating members such as cleats. Outsole 1222 can have different material characteristics to provide varying levels of traction with a ground. Examples of different materials that could be used for outsole 1222 include, but are not limited to: plastic, rubber, polymers as well as any other kinds of materials that are both durable and wear resistant.

A sole structure can include provisions for enhancing cushioning and shock absorption for an article of footwear. Article 1200 may include bladder system 1300. Generally, bladder system 1300 may be disposed in any portion of article 1200. In some cases, bladder system 1300 may be disposed in forefoot portion 10 of sole structure 1210. In other cases, bladder system 1300 may be disposed in midfoot portion 12 of sole structure 1210. In still other cases, bladder system 1300 may be disposed in heel portion 14 of sole structure 1210. In an exemplary embodiment, bladder system 1300 may be a full length bladder system that extends throughout forefoot portion 10, midfoot portion 12 and heel portion 14.

Bladder system 1300 may include outer bladder 1302. Outer bladder 1302 may comprise one or more layers that are generally impermeable to fluid. In the current embodiment, outer bladder 1302 comprises upper layer 1320 and lower layer 1322 that are joined together at first periphery 1321 and second periphery 1323. Moreover, upper layer 1320 and lower layer 1322 comprise a boundary surface that encloses interior cavity 1330.

Outer bladder 1302 includes first portion 1324 and second portion 1326 and third portion 1328 disposed between first portion 1324 and second portion 1326. First portion 1324 generally extends through forefoot portion 10. Second portion 1326 generally extends through heel portion 14. In some cases, third portion 1328 may be associated with midfoot portion 12.

In some embodiments, different portions of outer bladder 1302 may be separated. In an exemplary embodiment, however, first portion 1324, second portion 1326 and third portion 1328 may all be in fluid communication with one another. This arrangement allows fluid to circulate throughout the entirety of outer bladder 1302, which may enhance cushioning effects.

Bladder system 1300 can include valve member 1350 that facilitates the inflation of outer bladder 1302. Valve member 1350 is disposed within interior cavity 1330 of outer bladder 1302. Valve member 1350 comprises a plug-like portion that receives valve 1352 and supports the transfer of fluid into outer bladder 1302. In some embodiments, valve member 1350 may be substantially more rigid than outer bladder 1302. This arrangement helps protect valve 1352 as well as any tubing or fluid lines connected to valve 1352.

Generally, valve 1352 may be any type of valve that is configured to engage with an external pump of some kind. In one embodiment, valve 1352 could be a Schrader valve. In another embodiment, valve 1352 could be a Presta valve. In still other embodiments, valve 1352 could be any other type of valve known in the art.

In some cases, valve member 1350 may be configured to deliver fluid between an external pump and interior cavity 1330 of outer bladder 1302. In some cases, an interior portion of valve member 1350 can include fluid passage 1370 (shown in phantom in FIG. 14). Fluid passage 1370 may be a hollowed out portion of valve member 1350 that allows fluid to enter interior cavity 1330 from valve 1352.

In some embodiments, bladder system 1300 may include one or more tensile members disposed within outer bladder 1302. In the current embodiment, bladder system 1300 includes first tensile member 1304 and second tensile member 1306. Although two tensile members are used in the current embodiment, other embodiments could include a single inner member. Still other embodiments could include more than two tensile members.

In an exemplary embodiment, the structural features of first tensile member 1304 and second tensile member 1306 may be substantially similar to first tensile member 204 and second tensile member 206 discussed above. In particular, each tensile member can comprise two or more textile layers that are connected by a plurality of connecting members. In other embodiments, however, second tensile member 1306 could differ from first tensile member 1304 in size, shape, material characteristics as well as any other features.

A bladder system can include provisions for supporting various different portions of an article of footwear simultaneously. For example, in some embodiments including a first portion and a second portion of an outer bladder, the second portion may be reinforced using two tensile members and the first portion may be reinforced using a single tensile member. This configuration may help maintain the shape of the outer bladder over different regions of different thickness in the sole.

In the current embodiment, first tensile member 1304 has a size and shape to fit within heel portion 14 of outer bladder 1302. Additionally, second tensile member 1306 has a size and shape to extend through the entire length of outer bladder 1302. In particular, second tensile member 1306 extends through heel portion 14, midfoot portion 12 and forefoot portion 10 of outer bladder 1302. This configuration helps to provide support along the entire length of outer bladder 1302. In particular, this configuration maintains a larger height for heel portion 14 and a smaller height for forefoot portion 10 over a range of different inflation pressures for outer bladder 1302.

Figure 16:
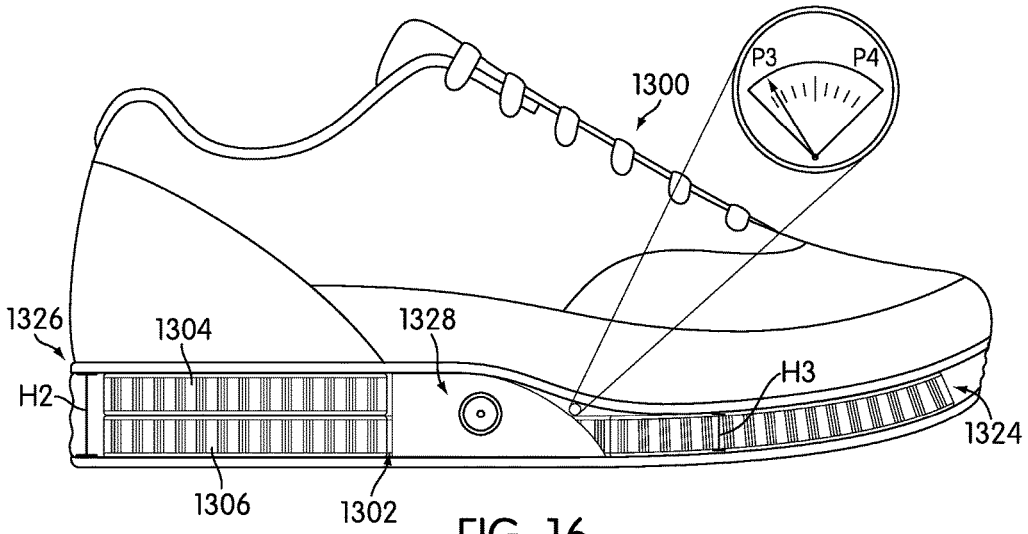
FIG. 16 is a side view of an embodiment of an article of footwear with a full length bladder system in a partially inflated state.
Figure 17:
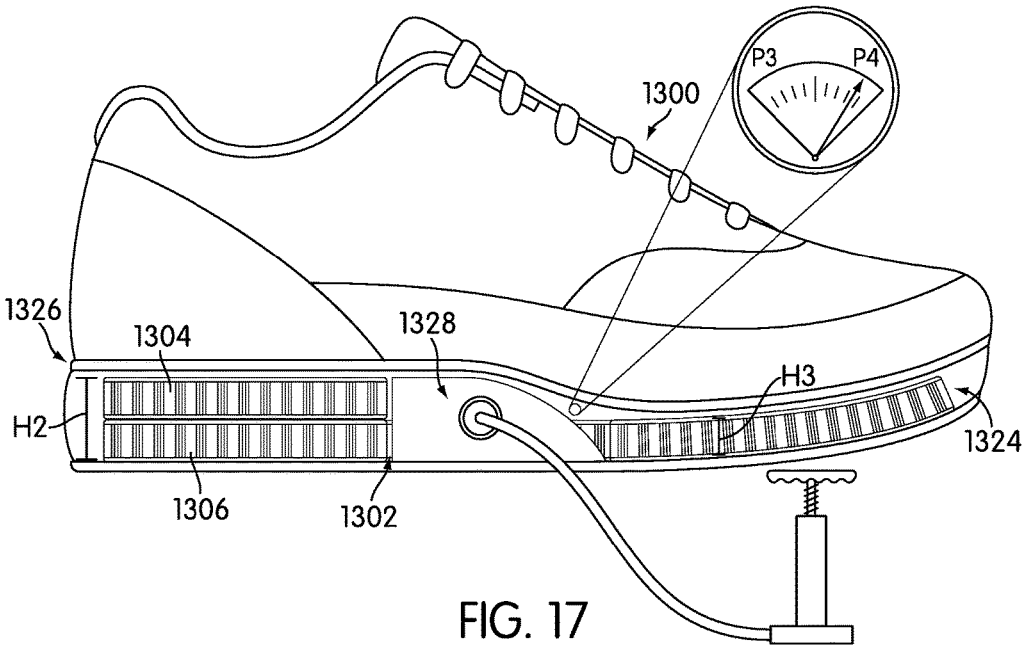
FIG. 17 is a side view of an embodiment of an article of footwear with a full length bladder system in a fully inflated state.

FIGS. 16 and 17 illustrate embodiments of bladder system 1300 in a partially inflated state and a fully inflated state. Referring to FIG. 16, outer bladder 1302 has been inflated to a pressure P3. In this partially inflated state, second portion 1326 has height H2 and first portion 1324 has height H3. In this case, height H2 is substantially greater than height H3. In other words, this configuration provides a raised configuration for a heel with respect to a forefoot for a user. Moreover, the height of second portion 1326 is constrained by the combined heights of first tensile member 1304 and second tensile member 1306. Likewise, the height of first portion 1324 is constrained by the height of second tensile member 1306

Referring now to FIG. 17, as outer bladder 1302 is inflated, the internal pressure of outer bladder 1302 is increased to pressure P4, which is substantially greater than pressure P3. As the internal pressure of outer bladder 1302 increases, the volume of first portion 1324 and second portion 1326 remain substantially constant. In particular, the height of first portion 1324 stays approximately constant with a height of H3. Likewise, the height of second portion 1326 stays approximately constant with a height H2. This arrangement helps to maintain a substantially constant shape for first portion 1324 and second portion 1326 regardless of the inflation pressure of outer bladder 1302. This may help to improve stability for a user.

Figure 18:
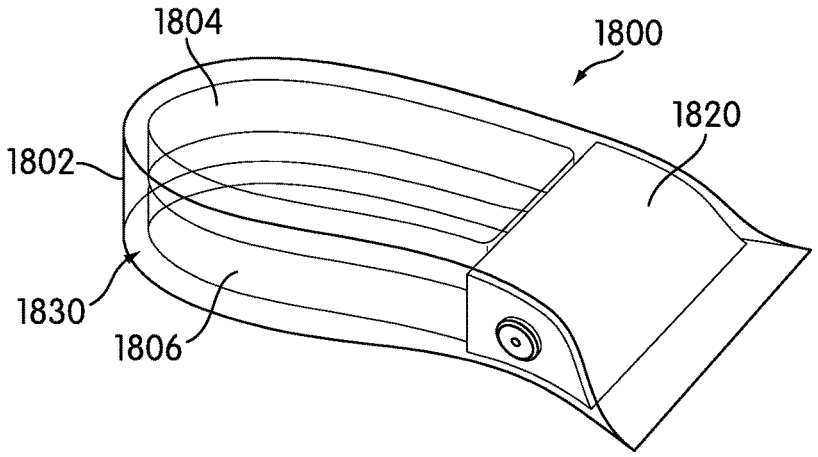
FIG. 18 is an isometric view of an embodiment of a bladder system including two inner bladders.
Figure 19:
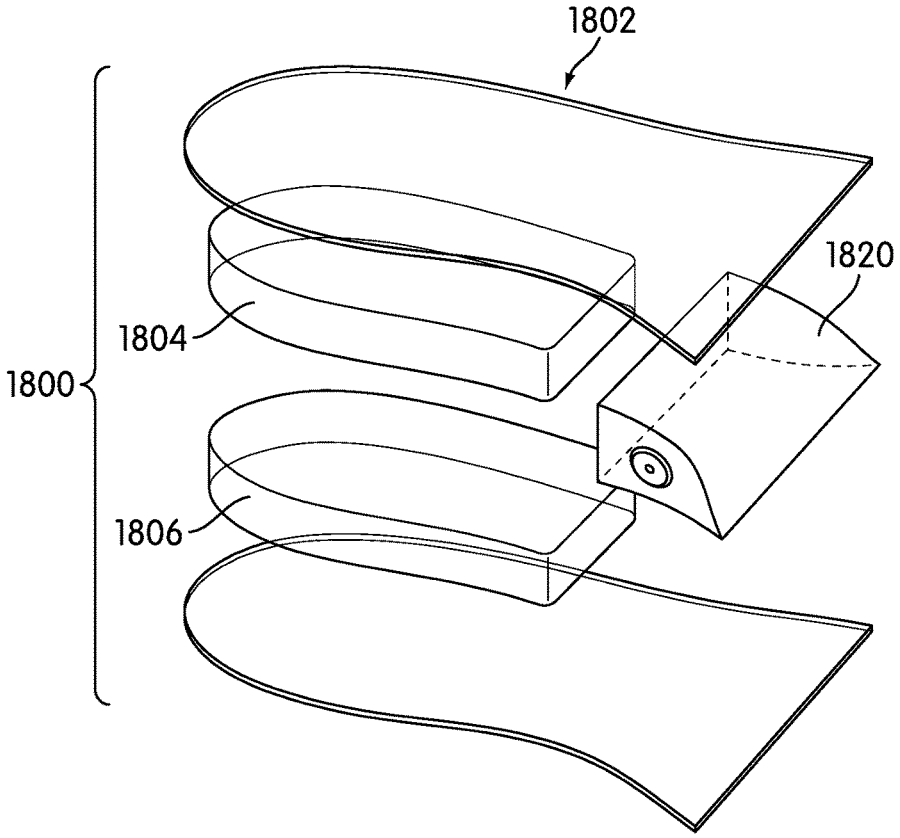
FIG. 19 is an exploded isometric view of an embodiment of a bladder system including two inner bladders.

Although the current embodiment uses tensile members to provide interior support for an outer bladder, in other embodiments other kinds of support structures could be used. For example, FIGS. 18 and 19 illustrate an embodiment of bladder system 1800 that includes inner bladders, rather than tensile members, for supporting an outer bladder. Referring to FIGS. 18 and 19, bladder system 1800 includes outer bladder 1802, first inner bladder 1804 and second inner bladder 1806. Bladder system 1800 also includes valve member 1820 that is disposed within internal cavity 1830 of outer bladder 1802.

Generally, an inner bladder may be any type of bladder. In some cases, an inner bladder may be an inflatable bladder. In other cases, an inner bladder may not be inflatable. In other words, in some cases, the amount of fluid within the inner bladder may be fixed. In an exemplary embodiment, one or more inner bladders may be sealed bladders with approximately constant pressures. In particular, in some cases, the pressure of each inner bladder may be set at the time of manufacturing.

In different embodiments, inner bladders can be arranged within an outer bladder in any manner. In some cases, first inner bladder 1804 and second inner bladder 1806 may be stacked in a vertical manner within outer bladder 1802. This provides a stacked bladder structure that helps to reinforce the shape and geometry of outer bladder 1802.

Examples of different types of bladders that could be used as inner bladders can be found in U.S. Pat. No. 6,119,371 and U.S. Pat. No. 5,802,738, both of which are hereby incorporated by reference. Moreover, the properties of one or more inner bladders can vary. Some may include internal structures that enhance support and maintain resiliency for the bladders. Other inner bladders may comprise a single outer layer that encloses an interior cavity. In still other embodiments, one or more inner bladders could have any other material and/or structural properties.

In some embodiments, second inner bladder 1806 could be substantially similar to first inner bladder 1804. In other embodiments, however, second inner bladder 1806 could differ from first inner bladder 1804 in size, shape, material characteristics as well as any other features. In the current embodiment, second inner bladder 1806 may share substantially similar material and structural properties to first inner bladder 1804. In addition, second inner bladder 1806 may have a substantially similar geometry to first inner bladder 1804.

In different embodiments, the relative pressures of one or more bladders could vary. In one embodiment, first inner bladder 1804 and second inner bladder 1806 may be configured with substantially different internal pressures from outer bladder 1802. For example, in one embodiment, first inner bladder 1804 and second inner bladder 1806 could have internal pressures that are substantially greater than the maximum inflation pressure of outer bladder 1802. In other words, in some cases, the pressure of outer bladder 1802 may not be increased above the internal pressures of first inner bladder 1804 and second inner bladder 1806. Using this arrangement, first inner bladder 1804 and second inner bladder 1806 may be substantially stiffer than outer bladder 1802.

It will be understood, that in other embodiments, the relative internal pressures of each bladder could vary. In other embodiments, for example, first inner bladder 1804 and second inner bladder 1806 could have internal pressures substantially equal to or less than the maximum inflation pressure associated with outer bladder 1802.

In still other embodiments, an outer bladder can be filled with any other kind of structures that provide support and enhance the operation of a bladder system. Although the current embodiments show systems including tensile members and inner bladders, other embodiments could include any other kinds of support structures that can be placed inside a bladder. One example of a bladder with various kinds of support structures is disclosed in Peyton et al., U.S. Pat. No. 8,479,412, issued Jul. 9, 2013 (U.S. application Ser. No. 12/630,642, filed Dec. 3, 2009), the entirety of which is hereby incorporated by reference. Another example is disclosed in Peyton, U.S. Pat. No. 8,381,418 (U.S. application Ser. No. 12/777,167, filed May 10, 2010), the entirety of which is hereby incorporated by reference. An example of a bladder incorporating a foam tensile member is disclosed in Schindler, U.S. Pat. No. 7,131,218, the entirety of which is hereby incorporated by reference.

While various embodiments have been described, the description is intended to be exemplary, rather than limiting and it will be apparent to those of ordinary skill in the art that many more embodiments and implementations are possible that are within the scope of the embodiments. Accordingly, the embodiments are not to be restricted except in light of the attached claims and their equivalents. Also, various modifications and changes may be made within the scope of the attached claims.

The invention claimed is:

1. A bladder system for an article of footwear, the bladder system comprising:

a bladder having a forward end and a rearward end, the bladder bounding an interior cavity; and a valve member disposed inside the interior cavity, the valve member providing fluid communication between the interior cavity and an exterior of the bladder, the valve member including a valve configured to engage with an external pump, the valve member further including a first surface that is forwardly oriented toward the forward end of the bladder and that is at a decline toward the forward end of the bladder, a second surface that is rearwardly oriented toward the rearward end of the bladder, a third surface that is on a medial side of the valve member, a fourth surface that is opposite to the third surface and is on a lateral side of the valve member, and a fifth surface that is a flat lower surface.

2. The bladder system of claim 1, wherein the valve member is disposed adjacent to the forward end of the bladder.

3. The bladder system of claim 2, wherein the forward end is part of a forward portion of the bladder, the rearward end is part of a rearward portion of the bladder, and the first surface contacts an upper layer of the bladder and the fifth surface contacts a lower layer of the bladder, such that the valve member provides structural support to the forward portion of the bladder.

4. The bladder system of claim 3, wherein a width of the valve member is approximately equal to a width of the forward portion of the bladder.

5. The bladder system of claim 3, wherein a width of the valve member is between 80% and 100% of a width of the forward portion of the bladder.

6. The bladder system of claim 1, wherein the forward end is part of a forward portion of the bladder, the rearward end is part of a rearward portion of the bladder, the bladder includes a middle portion in between the forward portion and the rearward portion, the forward portion, the middle portion, and the rearward portion of the bladder are in fluid communication, and the valve member extends partially across a width of the middle portion of the bladder, leaving a remaining width of the middle portion of the bladder.

7. The bladder system of claim 6, further comprising a tensile member disposed in the interior cavity.

8. The bladder system of claim 7, wherein the tensile member extends through the forward portion of the bladder, the middle portion of the bladder, and the rearward portion of the bladder.

9. The bladder system of claim 1, wherein the valve is exposed on the third surface.

10. The bladder system of claim 1, further comprising a tensile member disposed in the interior cavity.

11. The bladder system of claim 1, further comprising an inner bladder disposed in the interior cavity.

12. The bladder system of claim 1, wherein the second surface forms an entire rear face of the valve member, wherein the fifth surface forms an entire bottom face of the valve member, and wherein the first surface forms an entire top face and an entire front face of the valve member.

13. The bladder system of claim 12, wherein the valve member comprises a top rear edge separating the first surface and the second surface, a bottom rear edge separating the fifth surface and the second surface, a top medial edge separating the first surface and the third surface, a bottom medial edge separating the fifth surface and the third surface, a top lateral edge separating the first surface and the fourth surface, and a bottom lateral edge separating the fifth surface and the fourth surface.

14. A sole structure comprising the bladder system of claim 1 and an outsole, wherein the fifth surface is oriented toward the outsole.

15. The sole structure of claim 14, further comprising a midsole.

16. The sole structure of claim 14, wherein the valve member is located in a midfoot region of sole structure and is disposed adjacent to the forward end of the bladder.

17. The sole structure of claim 16, the forward end of the bladder is part of a forward portion of the bladder, and wherein a width of the valve member is between 80% and 100% of a width of the forward portion of the bladder.

18. The sole structure of claim 16, the forward end of the bladder is part of a forward portion of the bladder, and wherein a width of the valve member is approximately equal to a width of the forward portion of the bladder.

19. The sole structure of claim 14, wherein the bladder system extends through forefoot, midfoot, and heel portions of the sole structure.

20. An article of footwear comprising the bladder system of claim 1.

* * * * *